United States Patent [19]

Svensson

[11] 4,382,558

[45] May 10, 1983

[54] ROLLER MILL

[75] Inventor: Sven O. Svensson, Copenhagen, Denmark

[73] Assignee: F. L. Smidth & Co., Cresskill, N.J.

[21] Appl. No.: 131,870

[22] Filed: Mar. 19, 1980

[30] Foreign Application Priority Data

Mar. 19, 1979 [GB] United Kingdom ..... 7909564

[51] Int. Cl.[3] ..... B02C 4/00

[52] U.S. Cl. ..... 241/30; 241/37; 241/121

[58] Field of Search ..... 241/30, 33, 34, 37, 241/110, 117, 120, 121, 227

[56] References Cited

U.S. PATENT DOCUMENTS

| | | | |
|---|---|---|---|
| 2,909,330 | 10/1959 | Hardinge | 241/37 |
| 3,083,920 | 5/1962 | Schauer | 241/117 |
| 3,117,734 | 1/1964 | McCarty et al. | 241/37 X |
| 3,292,869 | 12/1966 | Beyeler | 241/37 |
| 3,591,094 | 7/1971 | Gauer | 241/37 |
| 3,782,646 | 1/1974 | Brundiek | 241/117 |
| 3,799,456 | 3/1974 | Jewell et al. | 241/37 |

*Primary Examiner*—Mark Rosenbaum
*Assistant Examiner*—Timothy V. Eley
*Attorney, Agent, or Firm*—Pennie & Edmonds

[57] ABSTRACT

A method is disclosed for operating a roller mill of the type having a rotating grinding path upon which one or more grinding rollers are disposed for rotatably grinding the material to be ground. In particular, a method is disclosed for maintaining a constant predetermined thickness of the grinding cushion between the grinding roller or rollers and the grinding path. More particularly, according to the invention the mean grinding pressure increases within fixed limits when the mean thickness of the grinding cushion is larger than predetermined, and decreases when the mean thickness of the grinding cushion is smaller than predetermined. The invention also pertains to an improved roller mill of the type described, for practicing the inventive method.

12 Claims, 1 Drawing Figure

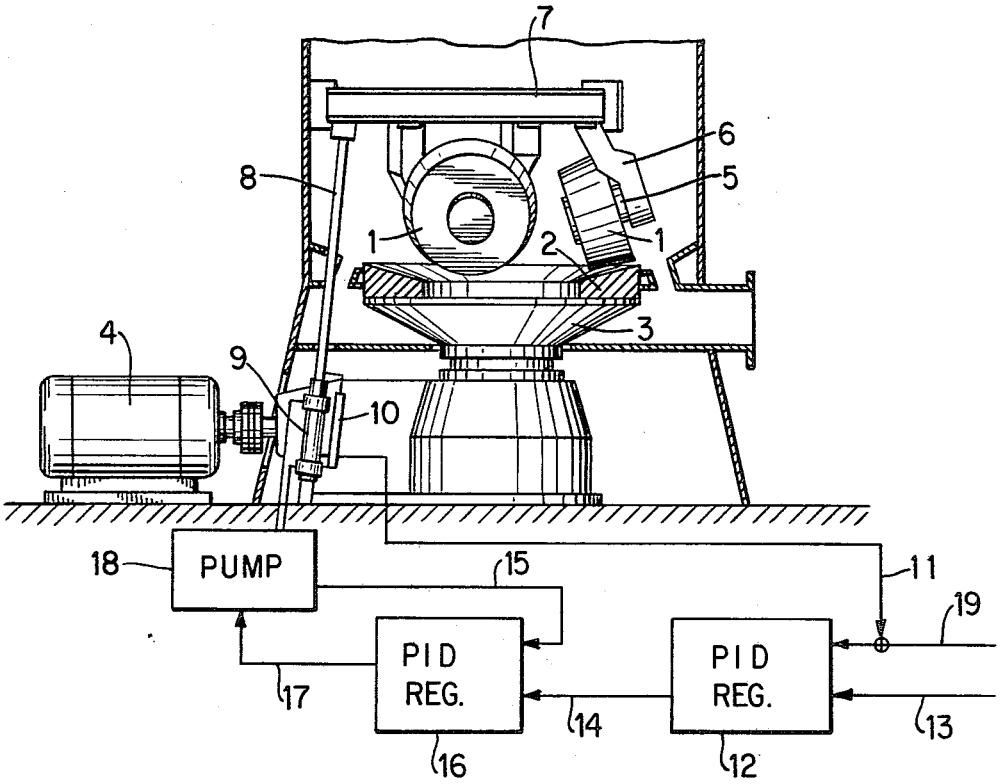
7
6
5
8
1
2
1
3
4
9
10
18
PUMP
15
11
19
PID
REG.
PID
REG.
17
14
13
16
12

ROLLER MILL

TECHNICAL FIELD

This invention relates to roller mills and in particular to roller mills in which the material to be ground is in the form of a grinding cushion and lies between one or more rollers and a grinding path. The rollers and the grinding path move relative to one another such that the rollers when pressed towards the grinding path, roll over the grinding cushion.

BACKGROUND ART

During rolling in a rolling mill, the thickness of the material layer to be rolled significantly influences the efficiency of the grinding. A thin material layer normally leads to a more efficient grinding and consequently an improved grinding economy. However, the thickness of the grinding cushion must not be too small, inasmuch as this would involve the risk of direct contact between the grinding path and the rollers. In turn, this would cause severe impacts with a consequent danger of damaging the mill installation. Thus, it is sought to maintain the thickness of the grinding cushion at a certain constant value during variable working conditions.

The thickness of the grinding cushion is determined by the amount of feed and by the pressure with which the rollers are pressed towards the grinding path as well as by the granulometry, grindability, and humidity of the material fed.

In small mills the working pressure may be obtained by means of springs which provide for pressing the rollers towards the grinding path. In such mills, the thickness of the grinding cushion will adapt itself, depending upon the amount and properties of the material fed, to a thickness alllowing the springs to yield and provide the necessary grinding pressure. When the thickness of the grinding cushion has adjusted itself, any increase in the thickness will bring about an increased working pressure which will tend to reestablish the initial value of the thickness of the grinding cushion. Correspondingly, if the thickness of the grinding cushion is decreased, this will lead to a lowering of the working pressure.

In large mills, however, the grinding pressure cannot be obtained by means of springs of a reasonable size. Consequently, the rollers are pressed towards the grinding path by hydraulic means. This makes it possible to set the working pressure at a desired value, but such a present working pressure still does not avoid variations of the grinding cushion resulting from variations in the feed rate and grindability of the material. German publication DT OS No. 26 35 244 discloses controlling the hydraulics providing the grinding pressure in such a manner that the hydraulic system acts like a spring, i.e., that the working pressure increases or decreases proportionally with the deviation of the grinding cushion thickness from a mean value. In this manner, an adaptation of the grinding pressure is obtainable in regard to the grindability of the material, but at the expense of appreciable variation in the thickness of the grinding cushion.

I have invented an improved method of maintaining the thickness of the grinding cushion of a roller mill at a substantially constant predetermined value as well as an improved roller mill for practicing my improved method.

DISCLOSURE OF INVENTION

The invention relates to a method for maintaining the thickness of a grinding cushion of a roller mill at a substantially constant predetermined value, the roller mill having means for producing grinding pressures, comprising increasing the mean grinding pressure within a predetermined range when the mean thickness of the grinding cushion exceeds the predetermined value, and decreasing the mean grinding pressure within the range when the mean thickness of the grinding cushion is less than the predetermined value.

Thus it will be appreciated that the object is achieved by a method of operating a mill of the kind described wherein the thickness of the grinding pressure is increased continuously, up to a predetermined upper limit if necessary, or decreased continuously, for as long as the thickness of the cushion has any deviation above, or below, respectively, a predetermined thickness.

In known control systems the extent of any adjustment in the grinding pressure is directly related to the deviation in the thickness of the grinding cushion, resulting perhaps from a change in the properties of the material being ground. However, the method according to the present invention makes it possible to maintain the thickness of the grinding cushion with less deviation inasmuch as the total change of the mean grinding pressure is independent of the extent of change of the grinding cushion thickness from the mean thickness. Thus even a very small but recognizable increase in the mean thickness of the grinding cushion above the predetermined value, will cause, if necessary, the mean grinding pressure to increase to its highest permitted value. The terms mean pressure and mean thickness are used because the control system of course is so arranged as not to react to deviations in pressure and thickness which are caused by the granular nature of the material or the uneven distribution of the material on the grinding path.

Such an uneven distribution of the material can be smoothened by placing a scraper member in front of one or more of the rollers. Such scrapers smoothen the distribution of material along the grinding path by scraping surplus material inwards towards the centre of the grinding table.

The material feed rate to the mill may be arranged to be regulated by the grinding pressure so as to be reduced when the grinding pressure exceeds a preset value and increased when the grinding pressure is below another preset value. When, due to the grinding cushion thickness remaining above the predetermined thickness, the control system effects an increase of the grinding pressure to about the upper limit permitted, it can be taken as a sign that even the increased grinding pressure is not sufficient for keeping the thickness of the grinding cushion down to the desired value. As the thickness of the grinding cushion is present at its near optimum, and as the grinding pressure approaches the highest permitted, the mill operates near its maximum performance and a reduction of the amount of material fed is thus expedient.

The regulation of the amount of feed made as described only ensures that the amount of material supplied can be treated under a grinding pressure within the permitted limits, whereas no regulation is made of the amount of feed to reach the amount which is optimal with regard to the operation of the mill. Such a regulation must be made in another way, e.g. manually or automatically according to suitable parameters.

Since a typically hydraulic system requires some time for bringing about the correct grinding pressure in the system because a certain amount of time is involved in pumping when the pressure must be increased and in releasing the pressure from the system when the pressure must be lowered, it would be expedient if the pumping or the pressure reduction could be initiated the moment the necessity of pressure change is envisaged. As a result when a manually or automatically regulated forced change of the amount of feed is arranged, a temporary override of the feedback from the cushion thickness monitor can be caused and in turn can immediately initiate a forced increase of the grinding pressure immediately upon the material feed rate being regulated upwards, and can immediately initiate a lowering of the grinding pressure upon the material feed rate being regulated downwards. Afterwards the grinding pressure is again regulated in dependence on the desired cushion thickness.

Aside from the circumstance when the material feed rate is changed, under certain other working conditions, such as starting and stoppages, the grinding pressure may be arranged to temporarily adopt a value dependent upon the actual working condition. Thereafter, the grinding pressure is again regulated in dependence on the desired cushion thickness. If, for instance, it should prove when measuring a suitable parameter that there is a risk of overloading the mill, the grinding pressure can be forced to a suitable low value, whereby the grinding effect is reduced. When the risk of overloading has passed, the pressure is smoothly regulated to the value giving the grinding cushion thickness desired. Similarly, when starting the mill the grinding pressure can be set at a value which ensures that the rollers do not penetrate the grinding cushion, after which the pressure can be controlled by the actual grinding cushion thickness in accordance with the present invention.

The invention also includes a roller mill of the kind described for carrying out the new method. The roller mill includes hydraulic means for producing the grinding pressure and control system which comprises means for monitoring the thickness of the grinding cushion and means responsive to the monitoring means for controlling the hydraulic means and hence the grinding pressure in accordance with the operational requirements of the method of the present invention.

Preferably the roller mill has a rotating grinding table having a grinding path thereon, a plurality of grinding bodies positioned to be pressed toward the grinding path for grinding material forming a grinding cushion therebetween, structural means for supporting grinding bodies for grinding rotation along said grinding path, and controlled hydraulic means for providing forces which increase and decrease the grinding pressure. The mill also includes means for generating a signal which increases the grinding pressure within fixed limits when the mean thickness of the grinding cushion exceeds a predetermined value and decreases the mean grinding pressure within those limits when the mean thickness of the grinding cushion is less than the predetermined value. The grinding pressure is increased and decreased respectively by the hydraulic means.

BRIEF DESCRIPTION OF THE DRAWING

The present invention is described in detail below with reference to the accompanying drawing which is a partly-diagrammatic and partly-schematic side elevational view of a vertical roller mill.

BEST MODE FOR CARRYING OUT THE INVENTION

Referring to the drawing, a roller mill is illustrated wherein grinding takes place by means of a number of grinding bodies 1. These grinding bodies can be pressed towards a grinding path 2 of a rotating table 3 which is driven by a motor 4.

The grinding bodies 1 are pivotally mounted on pivots 5. Supporting arrangements 6 permit the pivots to be mounted on a common bridge 7 by means of which all the grinding bodies 1 can be pressed towards or lifted away from the grinding path 2 by means of a force which via a compression tension rod 8 is transferred from a double acting hydraulic cylinder 9. The thickness of the grinding cushion is monitored by a measuring device 10 which measures the position of the rod 8 in relation to the stationary hydraulic cylinder 9. A signal representative of the thickness of the grinding cushion is transmitted along a signal line 11 to a PID-regulator 12 in which the actual grinding cushion thickness is compared with a desired thickness which is representatively preset by a setting signal on a signal line 13. If, for instance, the grinding cushion thickness is larger than the desired, preset thickness, the regulator 12 provides a steadily increasing signal on a line 14. When this signal exceeds a signal on a line 15, which carries a signal reflecting the actual grinding pressure, another PID-regulator 16 provides a signal on a line 17 for a hydraulic pumping unit 18, which in turn raises the oil pressure. At a given moment, the raised oil pressure and consequently the larger grinding pressure will cause the grinding cushion to revert to the preset thickness. Thereafter, the signal on the line 14 ceases to increase and shortly the oil pressure adapts to the level determined by the signal on the line 14. Subsequently the output signal from the PID-regulator 16 on the line 17 ceases as does the increase of the oil pressure caused by the hydraulic pumping unit. If the grinding cushion thickness decreases below the present value the operation will be analagously reversed. The operation as described above takes into account the situation wherein the oil pressure is transferred to that part of the double acting hydraulic cylinder 9 which causes tension in the tension rod 8. Situations may, however, be contemplated in which it is desirable to reduce the grinding pressure to a value lower than that determined by the weight of the grinding bodies 1 and that of their suspension arrangements. In such cases, that part of the hydraulic cylinder 9 which causes compression in the rod 8 is activated. This of course means that an increased oil pressure results in a smaller grinding pressure.

In practice, there will constantly be pressure on both sides of the piston of the hydraulic cylinder 9. In a preferred embodiment, both ends of the cylinder will be connected to their separate respective hydraulic systems comprising a hydraulic pump and a valve for lowering the pressure. Also, both systems will be provided with a hydraulic accumulator of the type in which a confined amount of gas is compressed by the pressure within the system. In this fashion, the pressure exerted on the grinding rollers becomes elastic, thus allowing the said rollers momentarily to be forced away from their position during the passage of small unevenness in the grinding cushion. Control of the grinding cushion pressure is consequently provided by adequate control of the pressure difference in the two hydraulic systems between permissible minimum and maximum values, but the effect of this control corresponds to that described above in regard to the schematic presentation.

Examples of cases where a heavily reduced grinding pressure or direct raising of the grinding bodies from the grinding path would be desirable include the situation wherein the roller mill is empty when started or where the roller mill is operated under a no-load condition.

The grinding pressure signal on the line 15 could also be used to provide for controlling the amount of feed. If the grinding pressure surmounts a certain level this may be taken as a sign that the grinding cushion thickness cannot be kept at the value desired even when using the highest grinding pressure permitted. Consequently the only viable solution for reducing the grinding cushion thickness in such a case is to reduce the amount of feed. Correspondingly, a steady drop in the grinding pressure to a level below a certain value may be used as a signal that the mill is nearly empty and thus is capable of treating a larger amount of material than is being fed to it.

As indicated above, it is sometimes desirable to override the automatic control. For instance when the mill feed is increased manually the grinding cushion will grow and this again will call for an increased grinding pressure. If it is desired to prepare the mill for this even before the thickness of the grinding cushion has actually increased, this can be done by overriding the automatic controls in that when increasing the feed, a decaying signal corresponding to excessive grinding cushion thickness, is added to the signal given at any time on the signal line 11 through an additional inlet 19. Such a signal will call for an increase of the grinding pressure, but after a preset period of time it will decay so that the grinding cushion pressure is again controlled only by the signal on the signal line 11 representing the actual grinding cushion thickness. It is sought to give the added decaying signal a size and shape causing the grinding cushion pressure to grow concurrently with the increased feed in such a way that the grinding cushion thickness is kept constant.

Similar temporary signals indicating too small or too large grinding cushion thickness can equally be added to the signal on the line 11 if in connection with certain operations it is desired to override the control sequence according to the invention for a short while.

I claim:

1. A method for maintaining the thickness of a grinding cushion of a roller mill at a substantially constant predetermined value, the roller mill having means for producing a mean grinding pressure and means for monitoring a mean thickness of the grinding cushion, comprising monitoring the mean thickness of the grinding cushion, continuously increasing the mean grinding pressure within a predetermined range as long as the mean thickness of the grinding cushion exceeds said predetermined value and until the thickness of the grinding cushion has returned to said predetermined value, and continuously decreasing the mean grinding pressure within said range as long as the mean thickness of the grinding cushion is less than said predetermined value and until the thickness of the grinding cushion has returned to said predetermined value.

2. The method according to claim 1 wherein the roller mill includes means for feeding material to the grinding cushion, further comprising regulating the amount of feed in accordance with the grinding pressure so as to decrease said amount when the grinding pressure exceeds a predetermined first value and increase said amount when the grinding pressure is less than a predetermined second value.

3. The method according to claim 2 wherein an automatically regulated change of the amount of feed causes temporary disregard of said variation of the feed amount and initiates a forced increase of the grinding pressure when the amount of feed is regulated upwards, and initiates a lowering of the grinding pressure when the feed amount is regulated downwards, and thereafter the grinding pressure is again regulated in a generally smooth manner in accordance with the monitored value of the mean grinding cushion thickness.

4. The method according to claim 2 wherein a manually regulated change of the amount of feed causes temporary disregard of said variation of the feed amount and initiates a forced increase of the grinding pressure when the amount of feed is regulated upwards, and initiates a lowering of the grinding pressure when the feed amount is regulated downwards, and thereafter the grinding pressure is again regulated in a generally smooth manner in accordance with the monitored value of the mean grinding cushion thickness.

5. The method according to claim 4 comprising regulating said grinding pressure such that under certain working conditions such as starting and stoppages the grinding pressure is forced to reflect a predetermined value dependent upon the actual working condition, from which value the pressure is regulated in a generally smooth manner in accordance with the monitored value of the mean grinding cushion thickness.

6. A method for maintaining the thickness of a grinding cushion of a roller mill at a substantially constant preset thickness, the roller mill having means for producing a mean grinding pressure and means for monitoring a mean thickness of the grinding cushion, comprising monitoring the mean thickness of the grinding cushion and regulating the grinding pressure within a predetermined range in accordance with variations in the mean thickness of the grinding cushion about said preset thickness, continuously increasing the mean grinding pressure within said predetermined range as long as the mean thickness of the grinding cushion exceeds said preset thickness and until the thickness of the grinding cushion has returned to said preset thickness, and continuously decreasing the mean grinding pressure within said range as long as the mean thickness of the grinding cushion is less than said preset thickness and until the thickness of the grinding cushion has returned to said preset thickness.

7. The method according to claim 6 wherein regulating the mean grinding pressure includes increasing the mean grinding pressure when said mean thickness exceeds said preset thickness.

8. The method according to claim 6 wherein regulating the mean grinding pressure includes decreasing the mean grinding pressure when said mean thickness is less than said preset thickness.

9. A method for maintaining the thickness of a grinding cushion of a roller mill having a rotating grinding table having a grinding path thereon, a plurality of grinding bodies positioned to be pressed toward said grinding path to provide a grinding pressure for grinding material forming a grinding cushion therebetween, structural means for supporting grinding bodies for grinding rotation along said grinding path, means for monitoring a mean thickness of the grinding cushion and hydraulically controlled means for hydraulically providing increases and decreases in the grinding pressure comprising generating a signal which increases the grinding pressure within fixed limits when the mean thickness of the grinding cushion exceeds a predetermined value and decreases the grinding pressure within said limits when the mean thickness of the grinding cushion is less than said predetermined value, said grinding pressure being increased and decreased respectively by said hydraulic means, continuously increasing or decreasing the mean grinding pressure within a predetermined range as long as the mean thickness of the grinding cushion exceeds or is less than said predetermined value, respectively, and until the thickness of the grinding cushion has returned to said predetermined value.

10. A roller mill having a rotating grinding table having a grinding path thereon, a plurality of grinding bodies positioned to be pressed toward said grinding path to provide a grinding pressure for grinding material forming a grinding cushion therebetween, structural means for supporting grinding bodies for grinding rotation along said grinding path, means for monitoring a mean thickness of the grinding cushion, controlled hydraulic means for providing forces which increase and decrease the grinding pressure, means for generating a signal which continuously increases the grinding pressure within fixed limits as long as the mean thickness of the grinding cushion exceeds a predetermined value and until the thickness of the grinding cushion has returned to said predetermined value and continuously decreases the grinding pressure within said limits as long as the mean thickness of the grinding cushion is less than said predetermined value and until the thickness of the grinding cushion has returned to said predetermined value, said grinding pressure being increased and decreased respectively by said hydraulic means.

11. The roller mill according to claim 10 wherein said means for providing increases and decreases in the grinding pressure comprises means for measuring the thickness of the grinding cushion and means for increasing or decreasing the hydraulically provided forces respectively, dependent upon the thickness of the grinding cushion being either larger or smaller than the predetermined value.

12. A mill for maintaining the thickness of its grinding cushion at a substantially constant predetermined value, comprising means for producing grinding pressures by hydraulic forces, means for measuring the thickness of the grinding cushion and means for continuously increasing or decreasing the hydraulic forces as long as the thickness of the grinding cushion is either larger or smaller, respectively, than said predetermined value and until the thickness of the grinding cushion has returned to said predetermined value.

* * * * *